US008092292B1

(12) United States Patent
White

(10) Patent No.: US 8,092,292 B1
(45) Date of Patent: Jan. 10, 2012

(54) METHOD AND APPARATUS FOR A WAGERING GAME HAVING A GAME OUTCOME DETERMINED FROM A PLAYER SELECTED INDICIA SET

(75) Inventor: Michael L. White, Glenview, IL (US)

(73) Assignee: Primo Innovo, LLC, Glenview, IL (US)

( * ) Notice: Subject to any disclaimer, the term of this patent is extended or adjusted under 35 U.S.C. 154(b) by 429 days.

(21) Appl. No.: 12/380,321

(22) Filed: Feb. 26, 2009

(51) Int. Cl.
*A63F 9/24* (2006.01)

(52) U.S. Cl. ..... 463/13; 463/19; 463/20; 273/139

(58) Field of Classification Search ..... 463/11–13, 463/16, 19, 20, 22, 25, 30, 31; 273/138.1, 273/139
See application file for complete search history.

(56) References Cited

U.S. PATENT DOCUMENTS 5,431,408 A 7/1995 Adams
5,704,835 A 1/1998 Dietz
5,997,401 A 12/1999 Crawford
7,070,503 B2 7/2006 Rudolph
7,316,607 B2 1/2008 Gauselmann
7,371,170 B2 5/2008 Cregan
2006/0025199 A1 * 2/2006 Harkins et al. ..... 463/19
2006/0194628 A1 * 8/2006 Novellie ..... 463/13
2008/0200239 A1 * 8/2008 Gilmore et al. ..... 463/22
2008/0305852 A1 12/2008 Dussault
2009/0005145 A1 * 1/2009 White ..... 463/16

* cited by examiner

*Primary Examiner* — Hsien Ming Lee
(74) *Attorney, Agent, or Firm* — Michael L. White

(57) ABSTRACT

A game having a first and a second plurality of indicia randomly selected from an indicia set. The first and second plurality of indicia are displayed to a player. The player may elect to receive either: (i) an array formed from the first plurality of indicia, or (ii) an array formed from a third plurality of indicia randomly selected from the first and second plurality of indicia. A winning game outcome occurs when a winning combination of indicia occurs in predetermined array positions.

11 Claims, 8 Drawing Sheets

METHOD AND APPARATUS FOR A WAGERING GAME HAVING A GAME OUTCOME DETERMINED FROM A PLAYER SELECTED INDICIA SET

FIELD OF THE INVENTION

This invention relates to gaming, and more particularly, in one embodiment, to gaming machines.

BACKGROUND OF THE INVENTION

Gaming machines are a popular form of entertainment with gaming establishment patrons. Slot-type gaming machines form an array of randomly selected indicia. This array is displayed on either mechanical reels (in the case of electromechanical gaming machines) or on a video display (in the case of video gaming machines). Winning game outcomes occur when specific array positions, designated by paylines, are randomly assigned winning combinations of indicia.

SUMMARY OF THE INVENTION

In one embodiment, a wagering game forms a first array with a first plurality of indicia selected from an indicia set. A winning game outcome occurs when a winning combination of indicia occurs on an active payline. A second plurality of indicia is selected from the indicia set and, in one embodiment, is displayed to the player. In this embodiment, the player elects to receive a second array formed from either the first plurality of indicia, or a third plurality of indicia randomly selected from the first and second plurality of indicia. In either case, either the first or third plurality of indicia (depending upon the strategy selected) are randomly assigned array positions to form the second array. The player may improve the probability for receiving a winning game outcome by selecting the appropriate strategy.

BRIEF DESCRIPTION OF THE FIGURES

Various embodiments of the wagering game are described and illustrated in the accompanying figures. The figures are provided as examples only and are not intended to be considered as limitations to the invention. Similarly, numerical entries only represent exemplary information, and those skilled in the art understand that a variety of different values and alternate arrangements can be made. Consequently, the wagering game is illustrated by way of example and not by limitation in the accompanying figures in which.

DETAILED DESCRIPTION

The wagering game described in the following embodiments may be adapted for play on gaming machines similar to those commonly found in gaming establishments. Gaming establishments typically network gaming machines into a gaming system that facilitates the monitoring and support of each gaming machine in the system.

Figure 1:
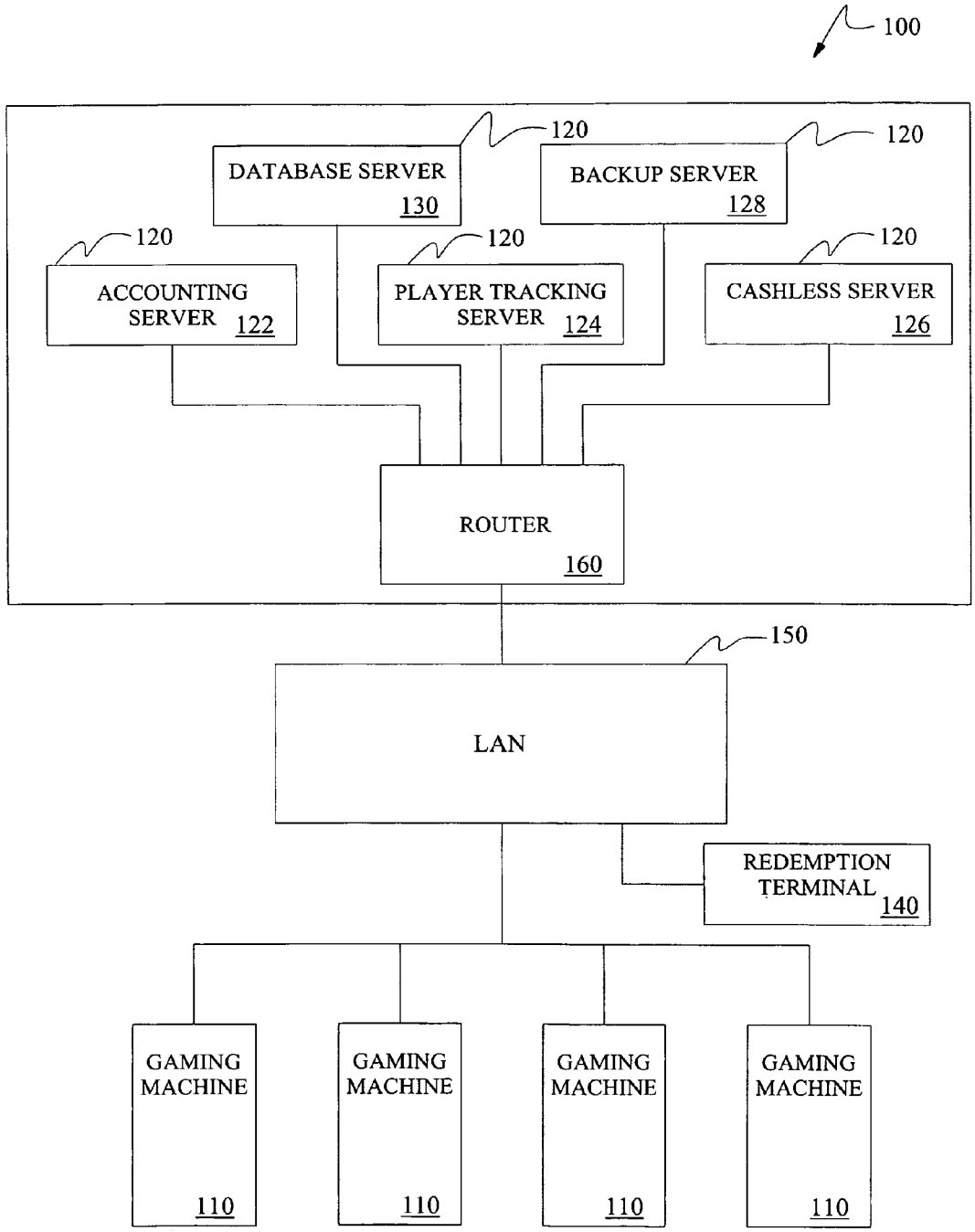
FIG. 1 is an exemplary block diagram of a gaming system.

Referring to FIG. 1, an exemplary gaming system 100 is illustrated. Gaming machines 110 on the floor of a gaming establishment are usually in communication with a number of servers 120 that provide ancillary support services for wagering activity at each gaming machine. These servers 120, and the gaming machines 110 they communicate with, are connected in a communications network (e.g., a local area network (LAN) 150 electronically linking the gaming system 100 together. Other network devices such as routers 160, storage devices (e.g., a database server 130), and backup servers 128 may also be part of the gaming system 100.

Although it is common practice to use several different servers, each dedicated to a particular gaming function, it is also possible to bundle these different gaming functions for execution on a single server. Servers 120 commonly found in some gaming systems include an accounting server 122 (records wagers and payouts), a player-tracking server 124 (tracks wagering activity of individual players), and a cashless server 126 (assists with the issue and redemption of wagering vouchers).

The player-tracking server 124 maintains a record of the player's wagering activity, allowing the gaming establishment to reward gaming patrons commensurate with their wagering activity. A player-tracking card is commonly provided to gaming patrons for participation in player loyalty programs sponsored by the gaming establishment. The player-tracking card is encoded with a unique player identification number that allows the player-tracking server 124 to maintain a record of player wagering activity.

The cashless server 126 maintains a record of issued vouchers. Vouchers are typically paper tickets with an imprinted monetary value that facilitates wagering. These vouchers are printed and accepted by gaming machines 110 to allow players to make wagers and cash out of the gaming machine. Each wagering voucher has a unique barcode identifier that acts as an index to a file in a database for retrieving information regarding the voucher (e.g., the specific monetary value of the voucher). Typically, the cashless server 126 stores this information in its database for recall when the voucher is presented for redemption.

When presented to a gaming machine 110, the voucher's barcode information is communicated to the cashless server 126, and the voucher is validated. The voucher value is communicated to the gaming machine 110 and credited for play on the gaming machine.

Other devices in the gaming system 100 may be present and in communication with the local area network 150. For example, a redemption terminal 140 (e.g., a computer terminal for a cashier or a self-serve kiosk) may be available to allow a player to cash out a voucher. This redemption terminal 140 is typically in communication with the cashless server 126 to facilitate monetary transactions.

The gaming machines 110, servers 120, and other network devices typically use serial communication protocols for transferring data over the gaming system's local area network 150. In other embodiments, gaming systems 100 may use Ethernet type communication protocols or any other communication protocol using any number of different types of communication media (including, e.g., optical fiber, radiofrequency, etc).

Regardless of whether a single or multiple servers 120 are utilized in the gaming system 100 embodiment illustrated in FIG. 1, in most gaming systems, the gaming machine 110 determines the game outcome and the servers 120 support the wagering and data collection activities of each gaming machine. A game program (i.e., software) controls the gaming machine 110 and is executed with a CPU (central processing unit or simply processor) in the gaming machine to determine the game outcome.

In other gaming systems, in lieu of executing a game program from a CPU in the gaming machine, the execution of the game program is performed by a CPU in a game server (not shown). For example, in one embodiment, the game server may execute a game program in response to initiation of the wagering game at a gaming machine 110. In this gaming system embodiment, the game server may perform all game program calculations and transmit video data to the gaming machine for display. Player selections may be transmitted from the gaming machine to the game server for further execution by the game program.

Alternatively, in still another gaming system embodiment, a CPU in the gaming machine and a CPU in a game server may each execute portions of a game program. For example, the game server may be limited to determining and transmitting random numbers to the gaming machine. The gaming machine uses these random numbers to determine, either directly or indirectly, game outcomes. Consequently, in one embodiment, the gaming system may be considered the gaming machine as the game program may be executed by a number of different discrete electronic devices (e.g., the game server and gaming machine as well as any other devices needed to execute the game program). In other embodiments, only the gaming machine 110 as depicted in FIG. 1 is necessary to execute the game program.

The gaming machine 110 illustrated in FIG. 1 is typically either an electro-mechanical gaming machine or a video gaming machine. The electro-mechanical gaming machine has mechanical reels to display game outcomes. In one embodiment, each reel is dedicated to the display of a single indicium in the array, providing the gaming machine the flexibility to individually select and display a random indicium in each array position. In contrast, video gaming machines have a video display for displaying game outcomes. With the exception of the game presentation (i.e., either mechanical reels or a video display), both types of gaming machines operate using the same basic principles.

Video gaming machines are adaptable to support many different types of wagering games (including the wagering game described and claimed in this specification). The electromechanical gaming machine may also be adapted to support embodiments of this wagering game—particularly those electromechanical gaming machines described above using independent reels to individually display each indicium in the array.

Figure 2:
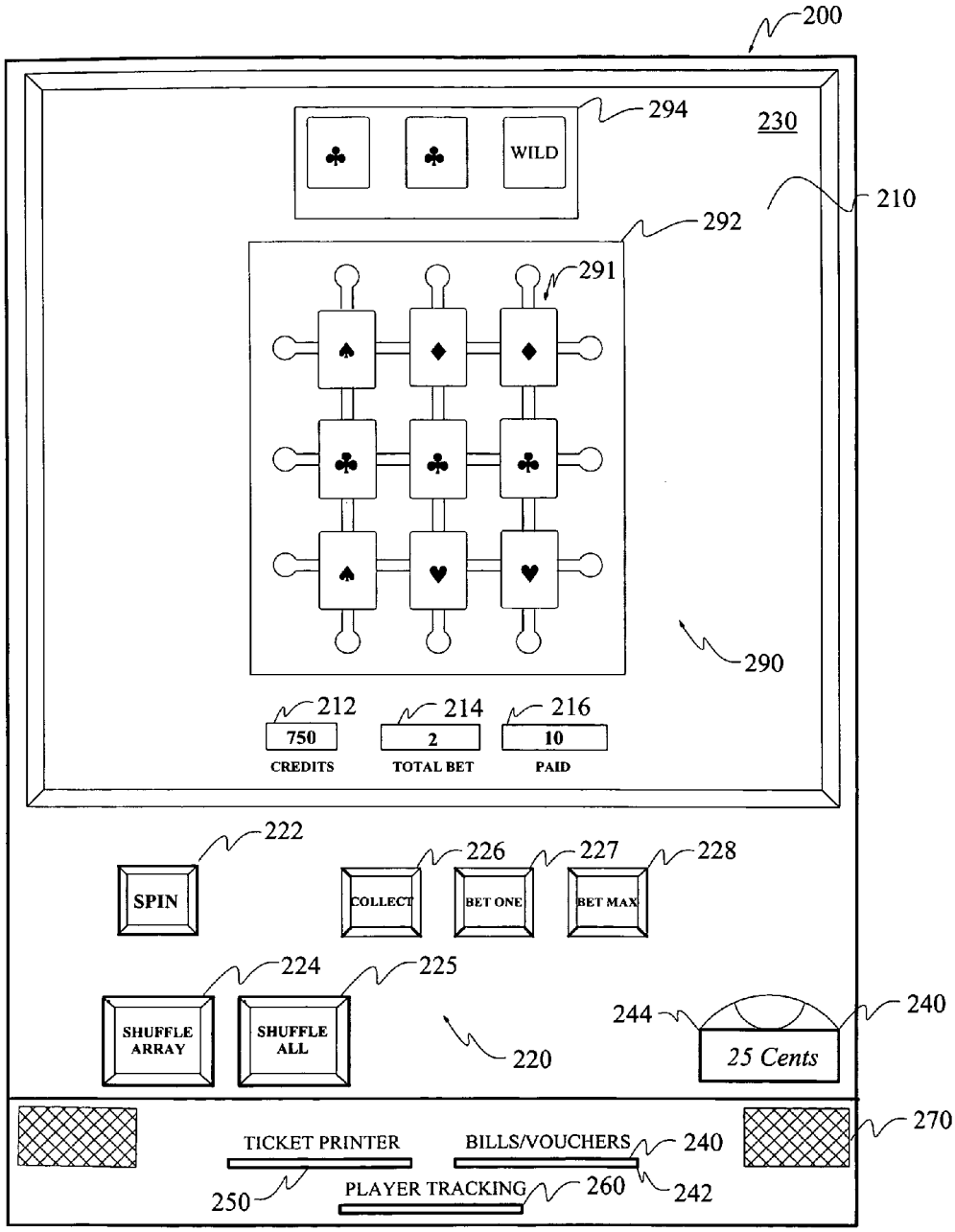
FIG. 2 is an orthogonal view of one embodiment of the gaming machine illustrated in FIG. 1.

FIG. 2 illustrates one embodiment of the gaming machine 110 depicted in FIG. 1. FIG. 2 depicts a video gaming machine 200 specifically adapted for play of the wagering game 290. The video gaming machine 200 has a wager acceptor 240 for initiating game play. The wager acceptor 240 may be a bill validator 242 (for accepting paper currency), a coin acceptor 244, or any other device capable of receiving and registering some form of acceptable monetary value. The bill validator 242 may, in some embodiments, also accept vouchers (generally in the form of paper tickets).

As discussed above, vouchers are printed by some video gaming machines 200 in lieu of paying coins when a player cashes out of the gaming machine. The video gaming machine 200, in this embodiment, has a ticket printer 250 which prints a voucher for the value of the cash out from the gaming machine. Typically, the voucher may be redeemed by a video gaming machine 200 by inserting the voucher into the bill validator 242. The bill validator 242 reads the barcode printed on the voucher, communicates with the cashless server to determine the value of the voucher, and credits the video gaming machine 200 for the value of the voucher.

The video gaming machine 200, in some embodiments, may have an alternative or additional payout mechanism such as a coin hopper (not shown on FIG. 2) internal to the gaming machine. The coin hopper dispenses coins to the player when the player cashes out.

The video gaming machine 200 may also include a card reader 260 for reading an identification card commonly known as a player-tracking card. The card reader 260 reads the player-tracking card and communicates the player's identification number to a player-tracking server.

Game play is initiated when the video gaming machine 200 receives a wager. The wagering game 290, in one embodiment, is displayed on the video display 210 of the video gaming machine 200. The video display 210 is generally a CRT or flat-panel display such as a LED or plasma display. However, any other type of display may be used to present the wagering game 290.

The video display 210 may also have a video representation of wagering meters to provide wagering information to the player. The meter display may include a credit meter 212 (displays total credits available for wagering), total bet meter 214 (displays the number of credits bet on each payline), and a paid credit meter 216 (displays payoff credits obtained from a winning game outcome).

In some embodiments, the player may make wagering selections using a pushbutton panel 220. For example, the player may designate the amount wagered on each individual payline (e.g., the bet one pushbutton 227 and the bet max pushbutton 228), the start of the game (e.g., the game start pushbutton 222), and the collection of credits on the gaming machine (e.g., using the collect pushbutton 226).

The pushbutton panel 220 may also be used by the player to implement game play decisions. For example, the player may elect to randomize the array 292 (i.e., randomly reassign the array indicia 291 to new array positions) shown in the wagering game 290 by selecting the Shuffle Array pushbutton 224. Alternatively, the player may elect to form a new array using indicia randomly selected from both the array 292 (i.e., the array indicia 291) and the supplemental indicia 294 using the Shuffle All pushbutton 225. These player selections are converted to an electrical signal with the actuation of the pushbutton and transmitted to the gaming machine CPU.

The video display 210 may operate, in some embodiments, in conjunction with a touch screen 230. To facilitate the play of a plurality of different games on a single video gaming machine 200, the touch screen 230 may serve as a means for inputting player selections. Icons representing various potential player selections may be presented on the video display 210. The player may touch an icon presented on the video display 210 to implement the corresponding function represented by the icon. In one embodiment the touch screen 230 may be used exclusively to control game play—eliminating the need for a pushbutton panel 220. In other embodiments, a combination of the pushbutton panel 220 and the touch screen 230 may be used to execute the player's game play decisions.

In addition, the video gaming machine 200 may provide sound effects or music to accompany game play through speakers 270. The speakers 270 may also provide game play information (e.g., audio help to the player).

Figure 3:
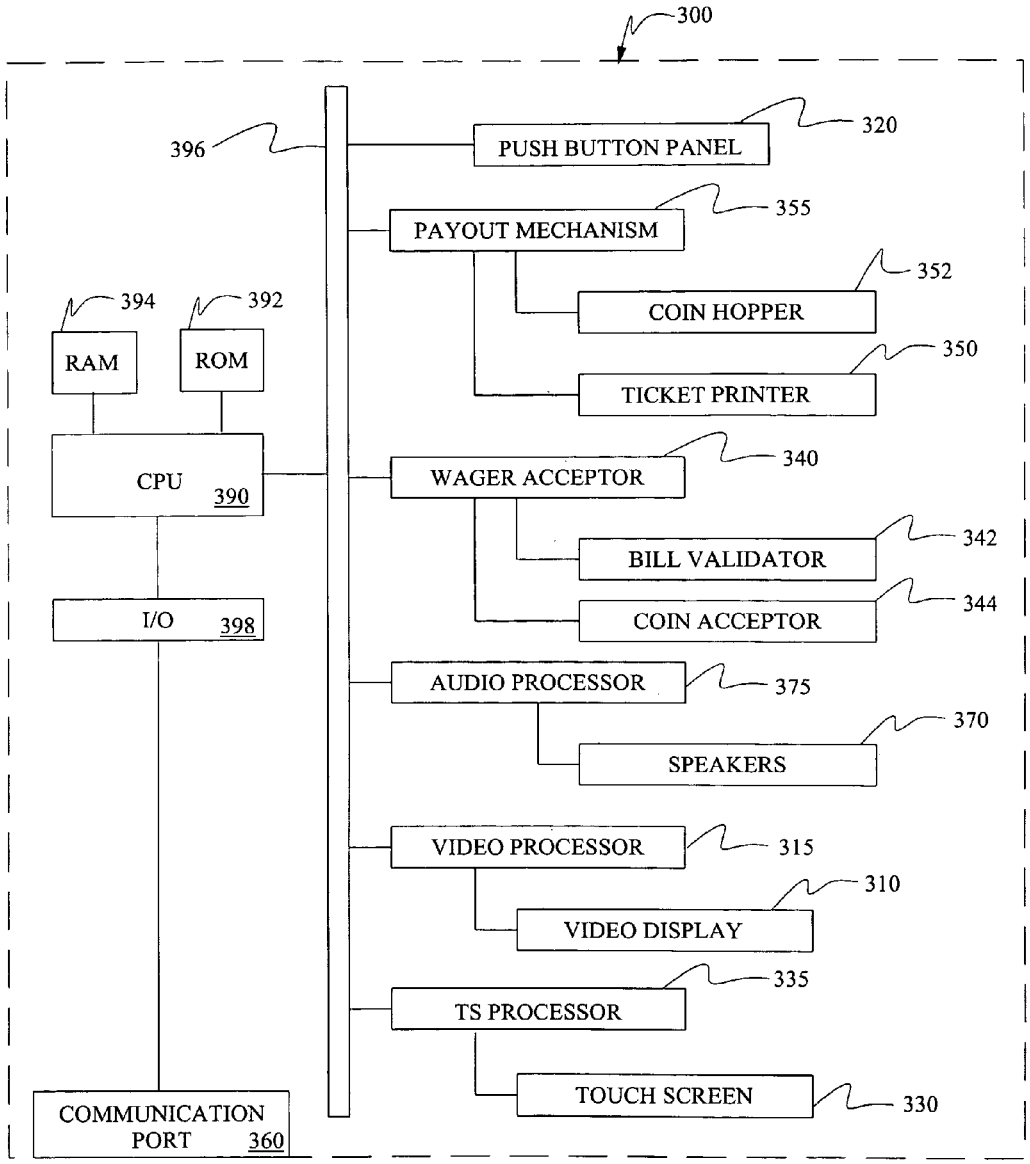
FIG. 3 is an exemplary block diagram of one embodiment of the control system of the gaming machine of FIG. 2.

With reference to FIG. 3, an exemplary control block diagram 300 is provided depicting the operational control of one embodiment of the video gaming machine 200 illustrated in FIG. 2. The central processing unit (CPU) 390, among other functions, controls the operation of peripheral devices ancillary to the operation of the gaming machine through the execution of the game program.

The CPU 390 has an internal I/O bus 396 to control communications between the CPU and the gaming machine's peripheral devices. The CPU 390 generally controls, either directly or indirectly, the bill validator 342 and coin acceptor 344 (more generally known as wager acceptors 340), the video display 310 (output controlled by video processor 315), the pushbutton panel 320, the coin hopper 352 and ticket printer 350 (more generally known as payout mechanisms 355), speakers 370 (output controlled by audio processor 375), and the touch screen 330 (input monitored by touch screen processor 335).

The CPU 390 not only controls and communicates with peripheral devices inside the gaming machine, but is also in communication with various servers that provide ancillary support services through a communication network as previously discussed. Typically, the CPU 390 also has a second, external I/O bus 398 that exchanges data with the communication network through communication port 360 in the gaming machine.

In addition to controlling each of the gaming machine's peripheral devices, the CPU 390, through the execution of the game program, also controls game play. The gaming machine has both non-volatile read-only memory (ROM) 392 in which the game program is stored and volatile random access memory (RAM) 394 from which the game program is executed by the CPU 390. In other embodiments, other electronic devices and specialty components may replace the ROM 392 and RAM 394 in the gaming machine including DRAM, disk drives, and other various types of flash memory. Even the ROM 392 may be replaced by flash memory devices to enable the uploading of new or upgraded game program software to the gaming machine.

The game play displayed by the gaming machine is typically determined by the CPU 390. In one embodiment, the CPU 390 randomly selects indicia from an indicia set by generating a random number with a random number generator (not shown). The random number generator (RNG) employs a mathematical formula to determine a random number using a numerical seed to start the mathematical computation. This numerical seed may be, for example, taken from a continuously rolling counter at the time the player selects a game outcome.

In one embodiment, the random number determined is within a predetermined numerical range and corresponds to a game outcome listed in a probability table stored in read-only memory 392. This random number designates the entry point to the probability table for determining the indicia to be displayed. In one embodiment, a separate random number is generated to determine each indicium in the wagering game.

In one embodiment, the probability table determines the probability of occurrence of any game outcome by associating each of the random numbers in a given range with a game outcome. The probability table may be weighted to achieve a desired game outcome distribution over a large number of game outcomes. This probability table in conjunction with a pay table listing the awards for winning game outcomes may be used to determine the gaming machine's payback percentage.

Once the indicia have been selected, the indicia are displayed to the player on the video display. More specifically, the CPU 390 in the video gaming machine signals the video processor 315 to display the wagering game on the video display 310.

With a general understanding of gaming machine operation, the wagering game executed by the game program may be described in further detail. In one embodiment, the wagering game may be broadly described as a slot type wagering game which allows a player to select from one of either two groups of indicia from which a game outcome is determined. The wagering game is described in more detail below in conjunction with the process flowchart 400 of FIG. 4 which depicts one exemplary embodiment of the game program.

Figure 4:
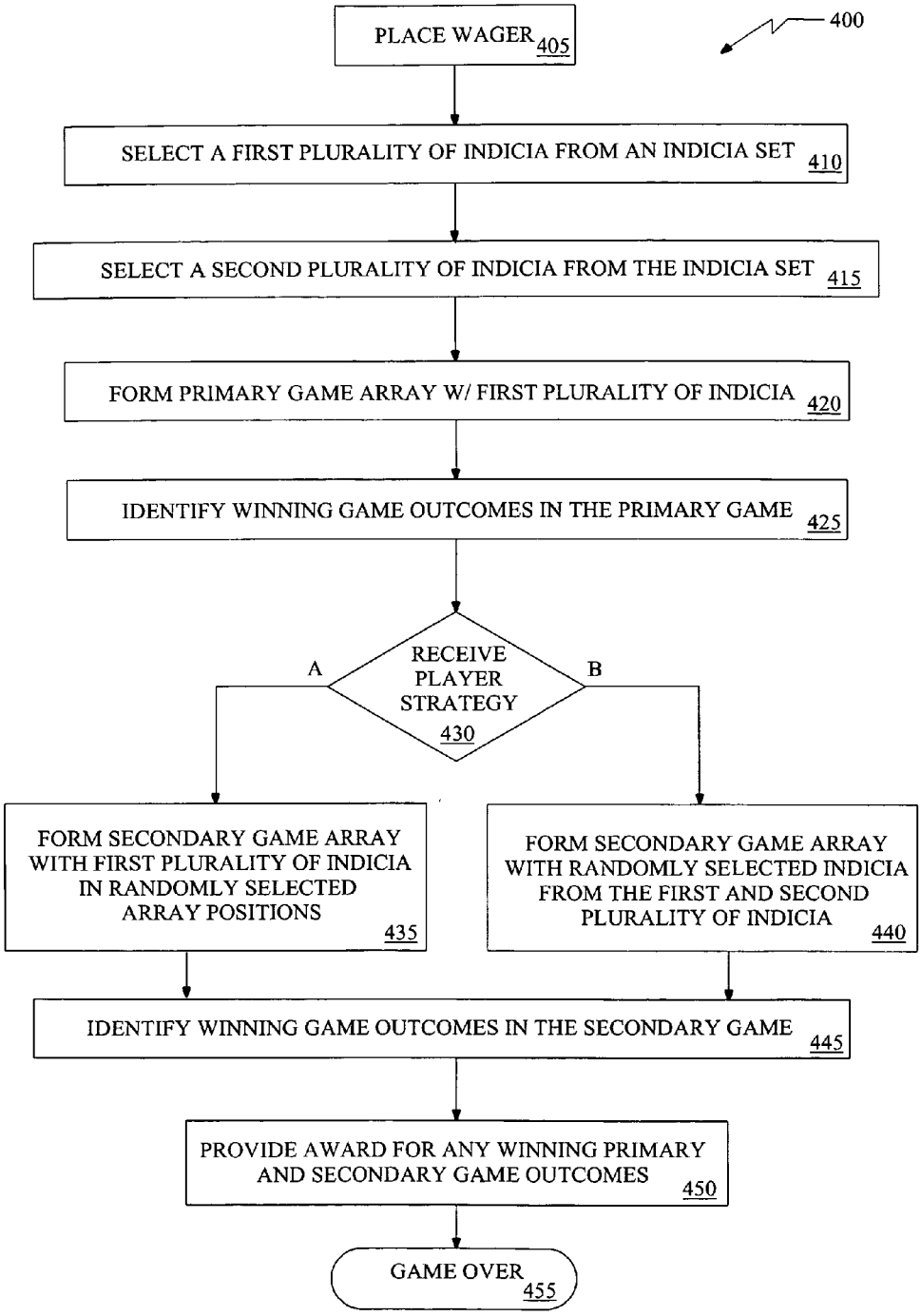
FIG. 4 is an exemplary process flowchart illustrating the game play of one embodiment of the wagering game.

Referring to FIG. 4, the process flowchart 400 provides an overview of the wagering game process. The wagering game starts with a wager in step 405. The gaming machine then randomly selects a first plurality of indicia from an indicia set in step 410. The gaming machine randomly selects a second plurality of indicia from the indicia set in step 415. In step 420, an array is formed with the first plurality of indicia. The gaming machine identifies in step 425 whether the randomly selected indicia in the primary game form any winning game outcomes.

The player next has an opportunity to select between two different strategies. The gaming machine receives the player's selection of either strategy A or B to continue game play in step 430. The first game play strategy ("A" as illustrated in FIG. 4) randomly assigns the first plurality of indicia to randomly assigned array positions to form a second array (i.e., a secondary game) as shown in step 435. Alternatively, the second game play strategy ("B" as illustrated in FIG. 4) creates a second array (i.e., an alternative secondary game) from the random selection of indicia from the first and second plurality of indicia to form a third plurality of indicia. This third plurality of indicia is randomly assigned to array positions to form a second array as described in step 440.

Winning game outcomes are identified in the secondary game in step 445. Awards are provided in step 450 for any winning primary or secondary game outcomes. The wagering game is over in step 455.

The embodiment described by the process flowchart 400 of FIG. 4 is but one embodiment of the wagering game. In some embodiments, in order to receive the secondary game, the player must place an additional wager. In other embodiments, as depicted in the process flowchart 400, the wager placed in step 405 covers game play for both the primary and secondary games.

In still another embodiment, only the secondary game is played; there is no primary game. In this embodiment, steps 420 and 425 are not necessary, and only the secondary game is available for play. In one such embodiment, the two groups of indicia (i.e., the first and second plurality of indicia) are shown to enable the player to make an informed strategy selection.

Figure 5:
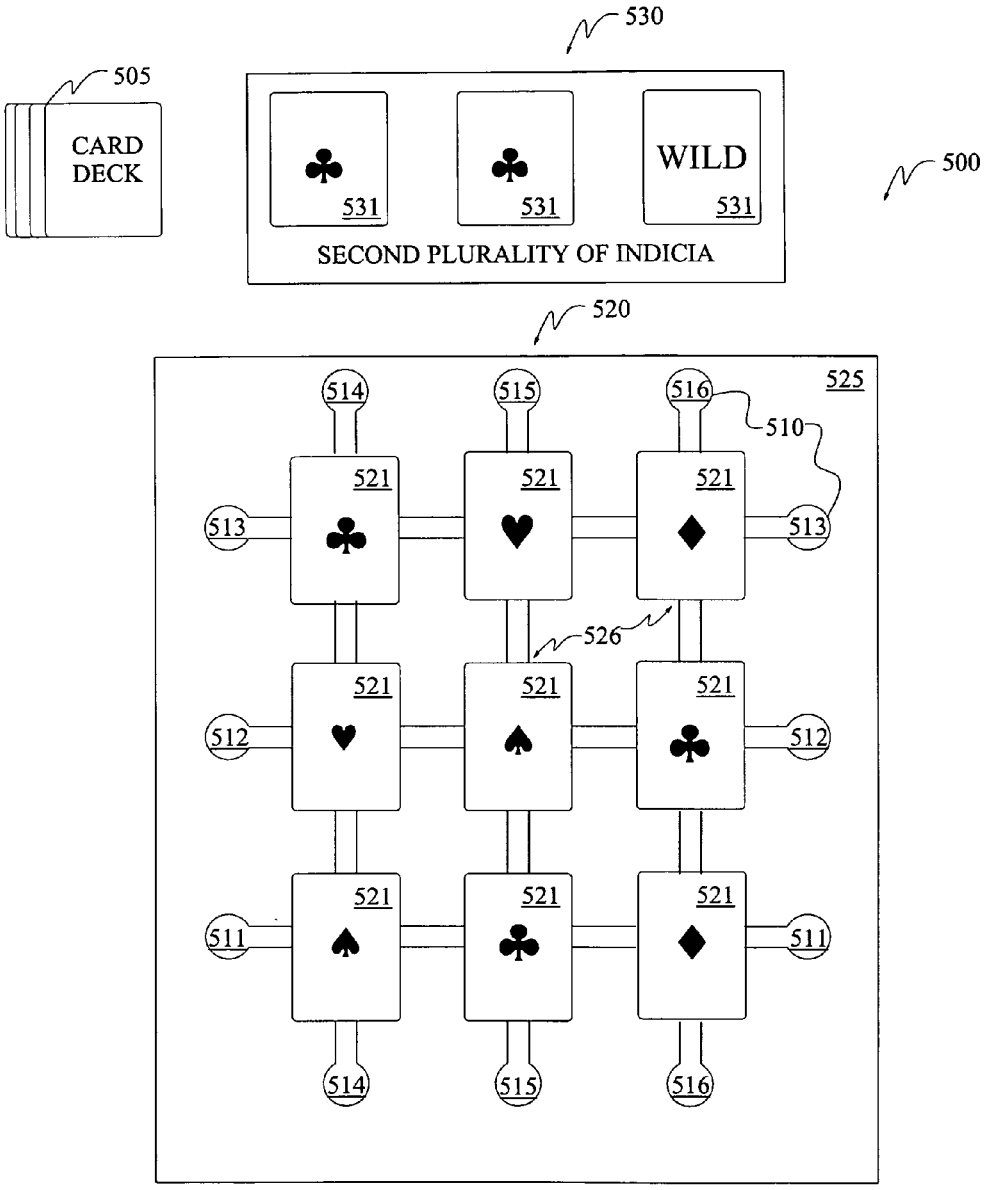
FIG. 5 is an exemplary primary game outcome of one embodiment of the wagering game illustrated by the flowchart of FIG. 4.
Figure 6:
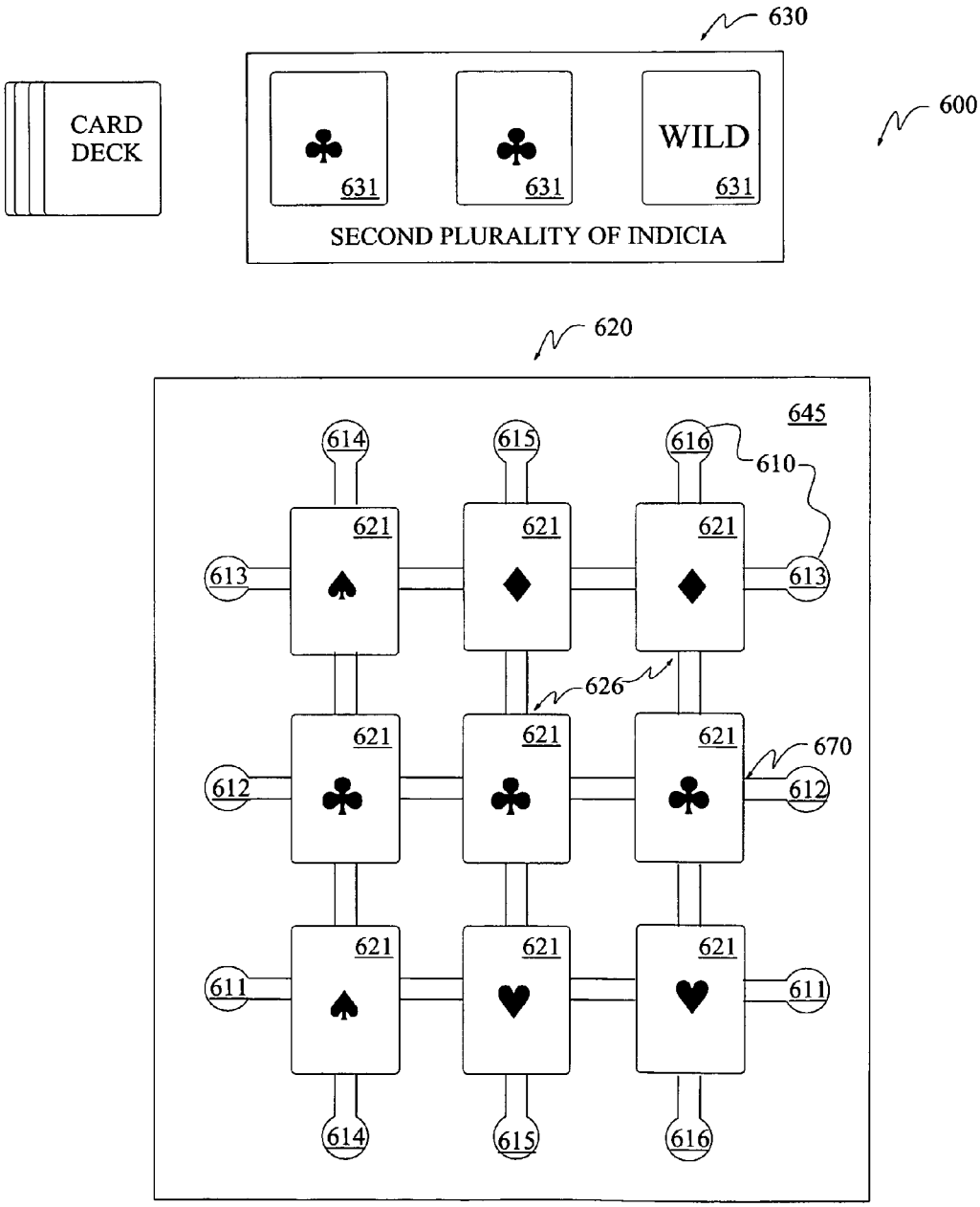
FIG. 6 is an exemplary secondary game outcome developed from the primary game outcome illustrated in FIG. 5 as a result of selecting a first strategy.
Figure 7:
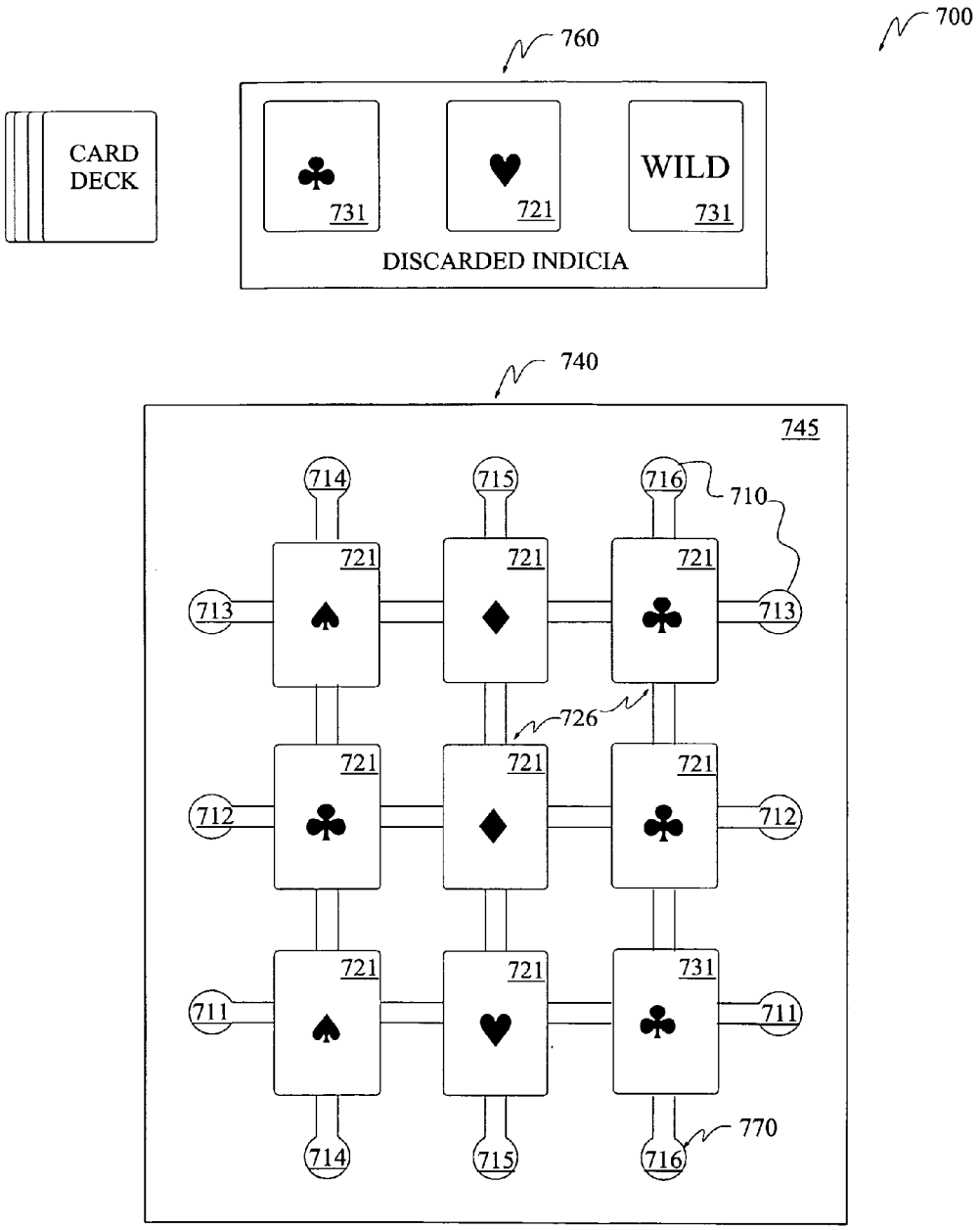
FIG. 7 is an exemplary secondary game outcome developed from the primary game outcome illustrated in FIG. 5 as a result of selecting a second strategy.

FIG. 5 through FIG. 7 illustrate one embodiment of an exemplary wagering game to compare and contrast the development of the wagering game using the two different player selectable game play strategies. In this embodiment, the exemplary wagering game generally follows the game play process depicted by the process flowchart 400 of FIG. 4.

Turning to FIG. 5, a wagering game 500 is illustrated with a primary game outcome depicted by the first array 525 having six paylines 510 (i.e., 511, 512, 513, 514, 515, 516)—three vertical and three horizontal—intersecting the first array 525. These paylines 510 designate array positions 526 that provide a winning game outcome in the event they contain winning combinations of indicia.

The first array 525 is formed from a first plurality of indicia 520 randomly selected from the indicia set 505. Each array position 526 in the first array 525 is assigned a first indicium 521 from the first plurality of indicia 520.

In addition to the first array 525, a second plurality of indicia 530 (depicted by the exemplary second indicia 531) is displayed to the player of the wagering game 500. The second plurality of indicia 530 is also randomly selected from the indicia in the indicia set 505.

In this exemplary embodiment, the indicia set 505 comprises the suits found in a standard card deck (i.e., Hearts, Diamonds, Spades, and Clubs). For ease of illustration, the indicia set 505 is depicted as a card deck. In this particular exemplary wagering game embodiment, the different suits may be considered as typical slot machine symbols.

In one embodiment, the player may wager on all, or less than all of the paylines 510 available in the first array 525. In order to win an award for a winning combination of indicia on a payline 510, the player must place a wager on that payline. For example, in this embodiment, a player may wager one credit on each of the paylines 510 (a total wager of six credits). In the exemplary wagering game depicted in FIGS. 5-7, it is assumed that all paylines have been made active with the appropriate wager.

All the different winning combinations of indicia are typically listed in a pay table that is generally accessible on the gaming machine to the gaming establishment patron. For the purposes of this exemplary embodiment, a winning game outcome requires three identical indicia on an active payline to be eligible for an award (e.g., three Diamond symbols) and all winning game outcomes have the same payoff value (i.e., the suits are all valued equally). In this embodiment, a winning game outcome pays a two credit award for a one credit wager when the winning combination of indicia (i.e., three identical symbols) appears on an active payline in the primary or secondary games. This pay table is for exemplary purposes only, and any suitable pay table may be determined for this wagering game 500.

Once the primary game depicted by the first array 525 has been determined, each individual payline 510 can be evaluated for a winning game outcome. In the exemplary primary game outcome depicted by the first array 525, the wagering game 500 has no winning indicia combinations on any of the paylines 510.

Continuing to follow the process flowchart 400 of FIG. 4, the player now has the opportunity to elect one of the strategies depicted in step 430. A second array may be formed by randomly assigning the first plurality of indicia into new array positions (step 435). Alternatively, the player has the option to form a second array with randomly selected indicia from a third plurality of indicia selected from the first and second plurality of indicia. Each indicium in the third plurality of indicia is randomly assigned an array position (step 440) to form the second array. Given these two options, the player may determine which strategy provides the greatest probability of a winning game outcome.

For example, the second plurality of indicia 530 includes two Clubs and a "Wild" indicium. The potential exists that a third plurality of indicia might be selected that includes all the Club indicia from both the first plurality of indicia 520 and the second plurality of indicia 530 as well as the "Wild" indicium. Such a strategy could produce three winning game outcomes from the five Club indicia in combination with the "Wild" indicia. In addition, the "Wild" indicium could potentially produce winning game outcomes with other suits in the array. These winning game outcomes depend not only on the indicia selected for the third plurality of indicia, but also on the array positions of the indicia with respect to payline geometry.

Even the worst-case scenario for such a strategy is that at least three Club indicia will be available in any new array formed from a third plurality of indicia. Consequently, the highest probability for obtaining a winning game outcome is the random selection of a third plurality of indicia from which to build the new array. This strategy has a much higher likelihood of producing more winning game outcomes than simply randomly rearranging the first plurality of indicia to form a second array (which at best permits only a single winning game outcome from the three Club indicia). Both strategy options and their exemplary outcomes are discussed below and shown in FIG. 6 and FIG. 7.

Referring to FIG. 6, an exemplary secondary game outcome is illustrated by the second array 645 in wagering game 600 resulting from the randomization of the first array 525 depicted in FIG. 5. The first plurality of indicia 620 have been randomized (i.e., each first indicium 621 in the first plurality of indicia is randomly reassigned an array position 626) to form a new, second array 645 (the secondary game outcome). The second plurality of indicia 630 are not involved in this particular game play strategy, and consequently, none of the second indicia 631 in the second plurality of indicia are present in the second array 645.

Referring to FIG. 6, such an exemplary winning game outcome 670 has occurred with three Club indicia on payline 612. The remaining paylines 610 (611, 613, 614, 615, and 616) do not have three identical indicia required for a winning game outcome.

In contrast to the strategy selected for the wagering game illustrated by FIG. 6, FIG. 7 illustrates an exemplary secondary game outcome as a result of selecting the alternative strategy (i.e., strategy "B" in step 430 of FIG. 4). Turning to FIG. 7, an exemplary secondary game outcome is depicted by the second array 745 resulting from the player's election to randomly select indicia from both the first and second plurality of indicia to create a third plurality of indicia 740. This third plurality of indicia 740 is randomly assigned array positions 726 to form the second array 745. The discarded indicia 760 (i.e., indicia not included in the second array 745 from the first and second plurality of indicia) are also displayed in FIG. 7. The discarded indicia 760 include two second indicia 731 and one first indicium 721.

By inspection, the second array 745 has gained one second indicium 731—a Club indicium—and a winning game outcome 770 with three Club indicia on payline 716 has been formed. The remaining paylines 710 (i.e., 711, 712, 713, 714, and 715) do not have the required three identical indicia to form a winning game outcome.

In the wagering game embodiment depicted in the flowchart of FIG. 4, the secondary game outcome illustrated in FIG. 7 would end the wagering game 700. In another embodiment, however, additional wagers (one or more) may be made by the player to receive the opportunity to again elect either one of the game play strategies and receive a new array based on the player selected strategy as applied to the last formed array. In one embodiment, the player may continue to make these additional wagers and strategy elections until a winning game outcome is obtained, or in other embodiments, until an upper limit on winning game outcomes or a total number of wagers is reached.

For example, a player may elect to randomize the secondary game in repeated attempts to obtain a winning game outcome. Alternatively, the player may elect to repeatedly create a new secondary game formed from a third plurality of indicia. The player may alternate between the two strategy elections as desired. For example, in this embodiment, the player can attempt to optimize the indicia present in the secondary game and subsequently randomize the indicia in the array until a winning game outcome is obtained.

Figure 8:
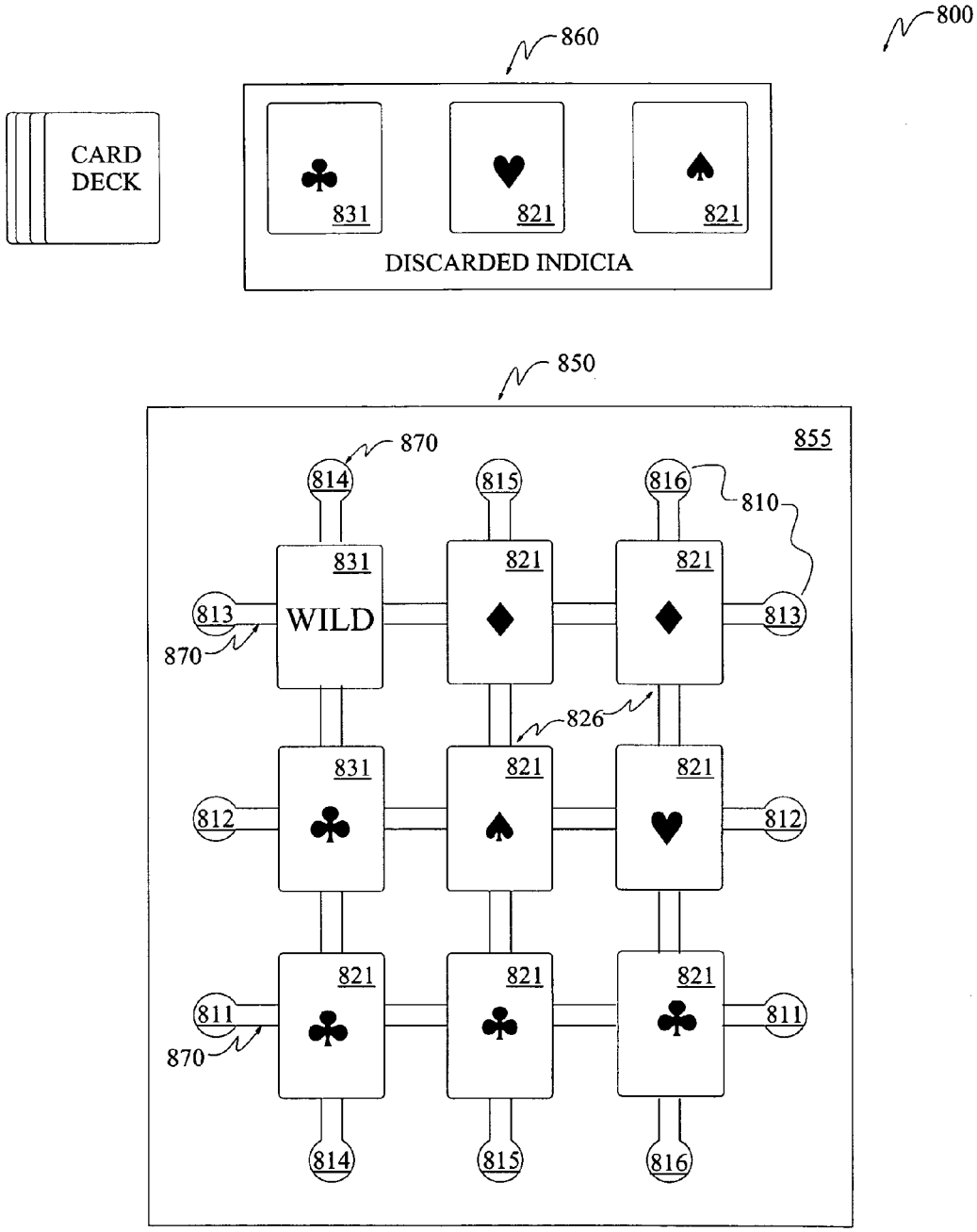
FIG. 8 is an exemplary game outcome developed from the secondary game outcome illustrated in FIG. 7.

One such embodiment of this wagering game is depicted by the exemplary game outcome of FIG. 8 illustrating the progression of the wagering game 700 illustrated in FIG. 7. The exemplary game outcome depicted as wagering game 800 in FIG. 8 is a result of the player electing to form a third array 855 from a fourth plurality of indicia 850 randomly selected from the first plurality of indicia (depicted by the first indicia 821) and second plurality of indicia (depicted by the second indicia 831) and randomly assigned to array positions 826. Discarded indicia 860 are also displayed that were not selected from the first and second plurality of indicia.

As result, by inspection of FIG. 8, three winning game outcomes 870 have been obtained for the wagering game 800 as follows: three Diamond indicia on payline 813 (using the "Wild" indicium to create the equivalent of a Diamond), three Club indicia on payline 814 (using the "Wild" indicium to create the equivalent of a Club), and three Club indicia on payline 811. None of the remaining paylines 810 (i.e., 812, 815, and 816) in the third array 855 have the required three identical indicia to receive a winning game outcome.

The exemplary embodiments described above are only one of a number of different potential embodiments of this wagering game. Other embodiments include, for example, multiple primary games (i.e., multiple first arrays) each formed with a different randomly selected first plurality of indicia from the same or different indicia sets. Each of the plurality of primary game arrays may be associated with the same second plurality of indicia for the purpose of forming a second array. The player may then simultaneously play each of the primary games by selecting one of the game play strategies for application to all the first arrays.

This wagering game can also be implemented in the form of a bonus game for a standard slot-type game. In this type of game, standard slot-type game play occurs in the base game until a triggering event occurs which transfers game play from the base to the bonus game. Typically, bonus games provide free game play (i.e., no further wager is required to play). Bonus games are generally triggered by predetermined base game outcomes. Various triggering mechanics can be employed; including, for example, the presence of a specific symbol in the first array (i.e., the base game in the bonus game embodiment).

In the bonus game embodiment, the occurrence of a trigger in the base game provides the player the opportunity to elect either of the optional game play strategies to create a new array. Consequently, when the trigger appears in the base game, the second plurality of indicia is displayed in conjunction with providing the player the ability to select one of the two game play strategies.

In general, any type of wagering or non-wagering game that requires the collection of specified indicia to form a winning game outcome may be adapted for play in this wagering game. For example, most card games can be implemented in the array. These card games include, for example, and not all-inclusive, Poker, Blackjack, and their variants. Other embodiments are possible that use games other than card games in the array. For example, as discussed above, the wagering game can be applied to slot-type games that typically use traditional slot-type symbols such as cherries, plums, and oranges.

Paylines are generally predetermined for any given array. Although the paylines for the various embodiments are either horizontal or vertical for ease of illustration, other embodiments may include paylines that may take any desired geometry.

Winning game outcomes may be determined using similar criteria as traditional slot-type games; for example, certain symbols (e.g., cherries), in a specified order (e.g., left to right), repeated a specified number of times. The symbols themselves may represent different monetary values; one symbol paying more than another symbol based on the probability of that symbol appearing in the game array.

Different types of indicia may be used dependent upon the type of game implemented in the game array. For example, card games use multi-characteristic indicia (e.g., a playing card) selected from an indicia set (e.g., playing card deck) to determine game outcomes.

Multi-characteristic indicia have a plurality of inherent parameters which either separately or taken together, may determine a game outcome. For example, a playing card is a multi-characteristic indicium having both a rank and suit. The player may have a winning game outcome based on the rank, suit, or both the rank and suit.

Multi-characteristic indicia may be comprised of a single symbol or multiple symbols. For example, a playing card has two symbols (e.g., the two of Spades indicium has a symbol for the rank (i.e., the number two) and a symbol for the suit (i.e., Spade). In other embodiments, a multi-characteristic symbol may consist of a single symbol. For example, a single symbol (e.g., a red number two) may have both a color parameter (red) and a numeric parameter (two).

Single characteristic indicia have only one parameter that can affect game outcome. Examples of single characteristic indicia include symbols used in some traditional slot-type gaming machines such as oranges, plums, and cherries.

In some embodiments, the indicia set may include duplicate indicia. For example, an indicia set may comprise two standard card decks. In other embodiments, the indicia set may be replenished as each indicium is selected from the set.

In other embodiments, the indicia set may include designated indicia that act as a "Wild" indicium. A "Wild" indicium, in some embodiments, may represent any indicium. Typically, and in at least one embodiment, the gaming machine determines all of the indicia that the "Wild" indicium may represent that provides a winning game outcome. Each of these winning game outcomes is credited to the player. For example, Jokers may be deemed to be wild cards and added to the indicia set. Alternatively, in another embodiment, certain indicia in the indicia set may be designated as a wild indicium.

While the invention has been illustrated with respect to several specific embodiments, these embodiments are illustrative rather than limiting. Various modifications and additions could be made to each of these embodiments as will be apparent to those skilled in the art. For example, the wagering game described herein could also be played as a non-wagering game. Accordingly, the invention should not be limited by the above description or of the specific embodiments provided as examples. Rather, the invention should be defined only by the following claims.

The invention claimed is:

1. A method of playing a wagering game with a gaming machine, comprising:

receiving a wager;

randomly selecting a first plurality of indicia from an indicia set;

forming a first array with the first plurality of indicia;

randomly selecting a second plurality of indicia from the indicia set;

receiving a selection to form a second array having a plurality of array positions;

forming the second array in accordance with the selection, wherein the selection comprises one of either:

(i) randomly assigning each indicium of the first plurality of indicia to one of the plurality of array positions in the second array; and (ii) randomly assigning each indicium of a third plurality of indicia to one of the plurality of array positions in the second array, the third plurality of indicia selected from the first and the second plurality of indicia; and awarding a winning game outcome;

wherein the first plurality of indicia and the second plurality of indicia are presented on a display prior to forming the second array to allow determination of the selection having greatest probability of forming the winning game outcome in the second array.

2. The method of claim 1, wherein said array positions in either the first array or the second array at least partially determine the winning game outcome.

3. The method of claim 1, wherein indicia from the indicia set in said array positions determine the winning game outcome.

4. The method of claim 1, further including receiving another wager to form the second array.

5. The method of claim 1, further including receiving another selection to form a third array, wherein forming the third array comprises one of either:

(i) randomizing the second array to form the third array; and (ii) randomly assigning each indicium of a fourth plurality of indicia to one of the plurality of array positions in the third array, the fourth plurality of indicia selected from the first and the second plurality of indicia.

6. A gaming machine for executing a wagering game, comprising:

a wager acceptor for accepting a wager;

a video display for displaying the wagering game;

a processor operative to:

randomly select a first plurality of indicia from an indicia set;

randomly select a second plurality of indicia from the indicia set, receive a selection for forming an array having a plurality of array positions; and form the array with the selection, wherein the selection comprises one of either:

(i) the first plurality of indicia; and (ii) a third plurality of indicia, the third plurality of indicia selected from the first plurality of indicia and the second plurality of indicia;

identify a winning game outcome in the array; and a payout mechanism for awarding the winning game outcome;

wherein the first and the second plurality of indicia are presented on the video display prior to forming the array to allow determination of the selection having greatest probability of forming the winning game outcome.

7. The gaming machine of claim 6, wherein indicia from the indicia set in said array positions determine the winning game outcome.

8. A method of playing a wagering game with a gaming machine, comprising:

receiving a wager;

randomly selecting a first plurality of indicia from an indicia set;

randomly selecting a second plurality of indicia from the indicia set;

receiving a selection for forming an array having a plurality of array positions;

forming the array with the selection, wherein the selection comprises one of either:

(i) the first plurality of indicia; and (ii) a third plurality of indicia, the third plurality of indicia selected from the first plurality of indicia and the second plurality of indicia;

and awarding a winning game outcome, wherein the first and the second plurality of indicia are presented on a display prior to forming the array to allow determination of the selection having greatest probability of forming the winning game outcome.

9. The method of claim 8, wherein said array positions at least partially determine the winning game outcome.

10. The method of claim 8, wherein indicia from the indicia set in said array positions determines the winning game outcome.

11. The method of claim 8, wherein the third plurality of indicia comprises indicia randomly selected from the first plurality of indicia and the second plurality of indicia.

* * * * *